US011910822B2

(12) United States Patent
Dimmick et al.

(10) Patent No.: US 11,910,822 B2
(45) Date of Patent: Feb. 27, 2024

(54) FILTER FOR A SMOKING ARTICLE OR AN AEROSOL GENERATING PRODUCT

(71) Applicant: British American Tobacco (Investments) Limited, London (GB)

(72) Inventors: Barry Dimmick, London (GB); Andrei Grishchenko, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 899 days.

(21) Appl. No.: 16/758,464

(22) PCT Filed: Sep. 27, 2018

(86) PCT No.: PCT/GB2018/052754
§ 371 (c)(1),
(2) Date: Apr. 23, 2020

(87) PCT Pub. No.: WO2019/081881
PCT Pub. Date: May 2, 2019

(65) Prior Publication Data

US 2020/0245675 A1 Aug. 6, 2020

(30) Foreign Application Priority Data

Oct. 25, 2017 (GB) ..... 1717567

(51) Int. Cl.

| | |
|---|---|
| ***A24D 3/06*** | (2006.01) |
| ***A24D 3/04*** | (2006.01) |
| *A24D 3/10* | (2006.01) |
| *A24D 3/17* | (2020.01) |

(52) U.S. Cl.
CPC ..... *A24D 3/061* (2013.01); *A24D 3/043* (2013.01); *A24D 3/10* (2013.01); *A24D 3/17* (2020.01)

(58) Field of Classification Search
None
See application file for complete search history.

(56) References Cited

U.S. PATENT DOCUMENTS

| | | | | |
|---|---|---|---|---|
| 3,916,914 | A | 11/1975 | Brooks et al. | |
| 2004/0261807 | A1 | 12/2004 | Dube | |
| 2005/0000531 | A1* | 1/2005 | Shi | A24B 15/287 131/347 |

(Continued)

FOREIGN PATENT DOCUMENTS

| | | | |
|---|---|---|---|
| CN | 103960776 | A | 8/2014 |
| EP | 3039972 | A1 | 7/2016 |

(Continued)

OTHER PUBLICATIONS

Korean Office Action for corresponding application 10-2020-7011691; Report dated Dec. 23, 2021.

(Continued)

*Primary Examiner* — Dennis R Cordray
(74) *Attorney, Agent, or Firm* — CANTOR COLBURN LLP

(57) ABSTRACT

A filter for a smoking article or an aerosol generating product comprising filter material and three capsules comprising additive, the capsules being disposed in sequence in a direction along a longitudinal axis of the filter.

22 Claims, 3 Drawing Sheets

(56) References Cited

U.S. PATENT DOCUMENTS

| | | | | |
|---|---|---|---|---|
| 2005/0283958 | A1* | 12/2005 | Sanderson | D02G 1/12 28/263 |
| 2011/0120481 | A1* | 5/2011 | Besso | A24D 3/048 428/401 |
| 2012/0017926 | A1 | 1/2012 | Karles et al. | |
| 2012/0080043 | A1* | 4/2012 | Naenen | A24D 3/0216 493/42 |
| 2015/0296878 | A1* | 10/2015 | Mucalo | A24D 1/02 131/335 |
| 2016/0037824 | A1* | 2/2016 | Jordil | A24D 3/061 131/335 |
| 2016/0302478 | A1* | 10/2016 | Lavanant | A24D 3/066 |

FOREIGN PATENT DOCUMENTS

| | | | |
|---|---|---|---|
| GB | 2490728 | A | 11/2012 |
| GB | 2490739 | A | 11/2012 |
| JP | 2013055887 | A | 3/2013 |
| RU | 63647 | U1 | 6/2007 |
| UA | 97949 | C2 | 4/2012 |
| UA | 91879 | U | 7/2014 |
| WO | 9507633 | A1 | 3/1995 |
| WO | 0072705 | A1 | 12/2000 |
| WO | 2004073427 | A1 | 9/2004 |
| WO | 2006082525 | A1 | 8/2006 |
| WO | 2006090290 | A1 | 8/2006 |
| WO | 2006117697 | A1 | 11/2006 |
| WO | 2008015570 | A2 | 2/2008 |
| WO | 2008015573 | A2 | 2/2008 |
| WO | 2008084333 | A2 | 7/2008 |
| WO | 2008114153 | A2 | 9/2008 |
| WO | 2009024866 | A2 | 2/2009 |
| WO | 2009143338 | A2 | 11/2009 |
| WO | 2020055120 | A1 | 5/2010 |
| WO | 2010115829 | A1 | 10/2010 |
| WO | 2011121326 | A2 | 10/2011 |
| WO | 2012000646 | A1 | 1/2012 |
| WO | 2012080174 | A1 | 6/2012 |
| WO | 2012156695 | A1 | 11/2012 |
| WO | 2012156703 | A1 | 11/2012 |
| WO | 2014023557 | A1 | 2/2014 |
| WO | 2014068295 | A1 | 5/2014 |
| WO | 2014072735 | A1 | 5/2014 |
| WO | 2015013108 | A2 | 1/2015 |
| WO | 2015013135 | A1 | 1/2015 |
| WO | 2015014610 | A1 | 2/2015 |
| WO | 2015075804 | A1 | 5/2015 |
| WO | 2015101620 | A1 | 7/2015 |
| WO | 2016063180 | A1 | 4/2016 |
| WO | 2016092283 | A1 | 6/2016 |
| WO | 2016092284 | A1 | 6/2016 |
| WO | 2016092295 | A1 | 6/2016 |
| WO | 2017036586 | A1 | 3/2017 |
| WO | 2017055456 | A1 | 4/2017 |
| WO | 2017198876 | A1 | 5/2017 |
| WO | 2017145095 | A1 | 8/2017 |
| WO | 2017218110 | A1 | 12/2017 |
| WO | 2018002269 | A1 | 1/2018 |

OTHER PUBLICATIONS

Russian Office Action for corresponding application P75686959UA; Report dated Dec. 9, 2021.

International Search Report for corresponding application PCT/GB2018/052754 filed Sep. 27, 2018; dated Nov. 20, 2018.

Written Opinion of the International Search Authority for corresponding application PCT/GB2018/052754 filed Sep. 27, 2018; dated Nov. 20, 2018.

Written Opinion of the International Preliminary Examination Authority for corresponding application PCT/GB2018/052754 filed Sep. 27, 2018; dated Oct. 4, 2019.

International Preliminary Report on Patentability for corresponding application PCT/GB2018/052754 filed Sep. 27, 2018; dated Feb. 7, 2020.

Chinese Search Report for corresponding application 201880083196.1 filed Sep. 27, 2018; Report dated Sep. 8, 2023.

* cited by examiner

FILTER FOR A SMOKING ARTICLE OR AN AEROSOL GENERATING PRODUCT

TECHNICAL FIELD

The invention relates to a filter for a smoking article or an aerosol generating product, and to a smoking article or an aerosol generating product including a filter.

BACKGROUND

Known smoking article filters, such as cigarette filters, generally comprise a continuous tow of filamentary cellulose acetate. The cellulose acetate is gathered together to form a rod which is cut to form individual filter sections. The smoking article filter may be made of one segment of filter rod, or may be made from multiple segments, with or without a cavity or spaces between them.

SUMMARY

According to embodiments of the invention, there is provided a filter for a smoking article or an aerosol generating product comprising filter material and three capsules comprising additive, the capsules being disposed in sequence in a direction along a longitudinal axis of the filter.

The filter can comprise continuous filter material. The filter can comprise cellulose acetate filter material. The capsules can be embedded in the filter material. The capsules can be embedded in the cellulose acetate.

The capsules can be located within the filter at a position other than a longitudinally central position within the filter. The capsule can be located within the filter at a position from 1 mm to 10 mm from a longitudinally central position within the filter. Alternatively, the capsules can be disposed in sequence along the longitudinal central axis of the filter.

The capsules can be in predetermined locations and/or in a predetermined sequence.

In one embodiment, there are only three capsules in the filter.

In one embodiment, the filter does not contain microcapsules.

According to embodiments of the invention, there is also provided a smoking article or an aerosol generating product comprising a filter as defined above.

The filter comprises three capsules containing additive. The additive, such as flavourant, is encapsulated within the capsule. The capsules allow the consumer to release the additive when the filter is subjected to an external force. Releasing the additive, such as flavourant, modifies the smoke passing through the filter. Encapsulating the additive can avoid unintentional release or migration of the additive during manufacture or storage.

The capsules can be frangible capsules. Frangible capsules allow the consumer to crush the capsules and release the contents of the capsule, e.g. additive/flavourant. Three capsules can provide the consumer with a choice of which additive/flavourant to release and/or how much additive/flavourant to release. For example, in an embodiment in which the three capsules contain the same additive/flavourant in the same amount, crushing 1, 2, or 3 of the capsules releases an increasing amount of additive/flavourant. Alternatively, in embodiments having three capsules containing different flavourants, the consumer is provided with a choice of which flavourant(s) to release, including different combinations of flavourants. For example, a single flavourant can be released, a combination of two of the three flavourants can be released, or all three flavourants can be released, e.g. at the same time. The range of choices available to the consumer is greatly increased when three capsules are employed. Three capsules also increases the range of pressure drops which the filter has to operate at (all capsules crushed, two capsule crushed, or a single capsule crushed).

The arrangement of the capsules in the filter, i.e. disposed in sequence in a direction along the longitudinal axis of the filter, ensures that when smoke is drawn through the filter in a longitudinal direction along the filter, the smoke comes in to contact with each capsule in a predetermined sequence. Hence, when the capsules are crushed the smoke can come into contact with the released additives/flavourants in a predetermined sequence. The placement of the capsules can therefore be designed to ensure the required additive effect, e.g. flavour, is achieved by the capsules. For example, when incorporated into a smoking article, a flavourant released from the capsule disposed furthest from the mouth end (ME) of the smoking article will have a reduced effect on the experience of the user compared to a flavourant released from the capsule disposed closest to the mouth end or the middle capsule. This effect can be used to create different/improved experiences (e.g. tastes) for the consumer.

Positioning the capsules in sequence along a longitudinal axis of the filter allows the additives released from the capsules to be mixed effectively. As smoke is drawn through the filter the smoke comes into contact with the capsules in a predetermined order, one after the other. Since the capsules are axially aligned along the filter the smoke that comes into contact with the first flavourant will subsequently come into contact with the second capsule and then the third capsule, providing efficient mixing. The consumer also has the choice of bursting any combination of capsules which increases the control the consumer has over the overall taste of the smoke and increases the range of tastes that the consumer can achieve.

The capsules comprise an additive. For example, the capsules can comprise a flavourant. The three capsules can contain the same flavourant or different flavourants. Where the three capsules contain the same flavourant, the capsules can contain the same amount or different amounts of flavourant.

The flavourant can be a liquid.

The flavourant employed in the capsules can be any flavourant suitable for use in a smoking article filter. For example, the flavourant may enhance the user's experience. Suitable flavours or flavourings include, but are not limited to, menthol, mint, chocolate, liquorice, citrus, redberry, blueberry, mojito, vanilla, spice flavours, plant essential oils, or other fruit flavours. Specific combinations of flavours include, but are not limited to, blueberry and mojito, redberry and menthol, or menthol and blueberry.

In some embodiments, the flavourant may be selected from one or more of a mint flavour, a citrus flavour and a fruit flavour. In some embodiments, the flavourant may be one or more of spearmint, citric and redberry. In some embodiments, the flavourant may be a combination of a mint flavour, a citrus flavour and a fruit flavour. In some embodiments, the flavourant may be a combination of spearmint, citric and redberry.

The capsules can be of any suitable weight. For example, the capsules can weigh from about 9 mg to about 18 mg, from about 11 mg to about 16 mg, or from about 13 mg to about 14 mg.

The capsule may have any suitable structure in which the additive/flavourant is encapsulated in the capsule. The capsule can comprise an outer shell and an inner core containing the additive/flavourant. The outer shell can be substantially continuous. The outer shell seals the additive/flavourant inside the capsule but the capsule, for example the outer shell, is frangible or breakable to allow the additive/flavourant to be icy released when an external force is applied to the capsule.

The capsules can have a burst strength of from about 0.8 kp (8 N) to about 2.4 kp (24 N), from about 1.2 kp (12 N) to about 2.0 kp (20 N), from about 1.4 kp (14 N) to about 1.8 kp (18 N), or about 1.60 kp (16N).

The capsule can have any suitable shape, such as, spherical, spheroid, cylindrical, or ellipsoid. The cross section perpendicular to the axis of the filter can be circular.

The diameter of the capsules is measured as the longest dimension of its cross section perpendicular to the axis of the filter. The diameter of the capsules can be from about 2.0 mm to about 6.0 mm. Alternatively, the diameter of the capsule can be less than about 3.5 mm. In some embodiments, the diameter of the capsules can be from about 2.2 mm to about 3.8 mm, about 2.4 mm to about 3.4 mm, about 2.6 mm to about 3.2 mm, about 2.7 mm to about 3.1 mm, about 2.8 mm to about 3.0 mm, or 2.8 mm, or 3.0 mm.

The filter material may comprise any suitable material or materials, such as cellulose acetate.

The filter material can have any suitable circumference, including but not limited to, from about 16 mm to about 25 mm, from about 16 to about 18 mm, from about 19 mm to about 22 mm, or from about 23 mm to about 25 mm.

The fibers of the filter material can have a fiber denier of from about 3.0 denier per filament (dpf) to about 10.0 dpf, from about 4.5 dpf to about 10.0 dpf, from about 4.5 dpf to about 8.0 dpf, from about 3.0 dpf to about 5.0 dpf, or from about 4.0 dpf to about 5.0 dpf.

The combination of a filter material having a specific circumference with a specific fiber denier has been found to be useful. Certain combinations provide acceptable levels of filtration whilst at the same time avoiding crushing of the capsules during the process employed to incorporate the capsules into the filter material.

In one embodiment, the circumference of the filter material can be from about 16 mm to about 18 mm, and the fibers of the filter material have a fiber denier of from about 4.5 dpf to about 10.0 dpf.

In another embodiment, the circumference of the filter material can be from about 19 mm to about 22 mm, and the fibers of the filter material have a fiber denier of from about 4.0 dpf to about 5.0 dpf. For example, the fiber denier can be about 5.0 dpf.

In another embodiment, the circumference of the filter material can be from about 23 mm to about 25 mm, and the fibers of the filter material have a fiber denier of from about 3.0 dpf to about 5.0 dpf. For example, the fiber denier can be about 3.0 dpf.

The filter material can have a total denier of from about 12,000 to about 40,000, from about 15,000 to about 40,000, from about 15,000 to about 23,000, from about 30,000 to about 35,000, or from about 35,000 to about 40,000.

The combination of a filter material having a specific circumference with a specific total denier has been found to be useful. Certain combinations provide acceptable levels of filtration whilst at the same time avoiding crushing of the capsules during the process employed to incorporate the capsules into the filter material.

In one embodiment, the circumference of the filter material can be from about 16 mm to about 18 mm, and the filter material has a total denier of from about 15,000 to about 23,000.

In another embodiment, the circumference of the filter material can be from about 19 mm to about 22 mm, and the filter material has a total denier of from about 25,000 to about 35,000. For example, the total denier can be about 30,000.

In another embodiment, the circumference of the filter material can be from about 23 mm to about 25 mm, and the filter material has a fiber denier of from about 30,000 to about 40,000. For example, the total denier can be about 40,000.

The filter can have a resistance to draw (RTD), before the capsule is crushed, of from about 75 mm/Wg to about 100 mm/Wg, or from about 80 mm/Wg to about 95 mm/Wg.

The filter can have a resistance to draw (RTD), after the capsule is crushed, of from about 85 mm/Wg to about 110 mm/Wg, from about 90 mm/Wg to about 100 mm/Wg.

In one embodiment, the circumference of the filter material can be from about 16 mm to about 18 mm, and the RTD before the capsule is crushed is from about 110 mm/Wg to about 160 mm/Wg.

In another embodiment, the circumference of the filter material can be from about 19 mm to about 22 mm, and the RTD before the capsule is crushed is from about 86 mm/Wg to about 94 mm/Wg, and/or the RTD after the capsule is crushed is from about 95 mm/Wg to about 100 mm/Wg.

In another embodiment, the circumference of the filter material can be from about 23 mm to about 25 mm, and the RTD before the capsule is crushed is from about 80 mm/Wg to about 85 mm/Wg, and/or the RTD after the capsule is crushed is from about 86 mm/Wg to about 92 mm/Wg A plasticizer can also be added to the fibers. Examples of suitable plasticizers include, but are not limited to, triacetin. The amount of plasticizer added to the fibers can be from about 2% to about 13%, about 2% to about 10% or from about 3% to about 6% by weight (wt/wt) of the fibers.

The capsules can be located in a single segment of the filter, or the capsules can be located in two separate segments of the filter.

The distance between the capsules can be any suitable distance. For example, the distance between the capsules can be from about 8 mm to about 12 mm, from about 7 mm to about n mm, from about 8 mm to about 10 mm, about 9 mm, or about 10 mm.

The length of the filter can be up to be about 50 mm, up to about 40 mm, up to about 35 mm, up to about 30 mm, up to about 25 mm, from about 16 mm to about 24 mm, from about 18 to about 22 mm, or about 20 mm. Alternatively, the length of the filter can be from about 20 mm to about 40 mm, from about 25 mm to about 35 mm, or about 30 mm. The length of the filter is measured parallel to the axis of the filter.

The three capsules can be equally spaced within the filter. Alternatively, the capsules can be unevenly spaced within the filter.

For illustration purposes, when incorporated into a smoking article, the third capsule is disposed closest to the mouth end, the first capsule is disposed furthest from the mouth end (i.e. closest to the tobacco rod end), and the second capsule is disposed between the first capsule and the third capsule.

In one arrangement, the three capsules can be spaced evenly along the axis of the filter. For example, the distance between the first capsule and the second capsule is the same as the distance between the second capsule and the third capsule. The distance between the first capsule and the second capsule can be from about 9 mm to about 11 mm; the distance between the second capsule and the third capsule can be from about 9 mm to about 11 mm; the distance between the first capsule and the tobacco rod end of the filter can be from about 4 mm to about 6 mm; and the distance between the third capsule and the mouth end of the filter can be from about 4 mm to about 6 mm.

In one arrangement, the filter comprises two or more filter sections. In one embodiment, the filter comprises a first filter section and a second filter section, the first filter section being disposed further from a mouth end of the filter than the second filter section.

The three capsules may be disposed in any of the two or more filter sections. For example, the first capsule may be disposed in the first filter section and the second and third capsule may be disposed in the second filter section. Alternatively, the first and second capsule may be disposed in the first filter section and the third capsule may be disposed in the second filter section. The second capsule is disposed between the first and third capsule.

The respective lengths of the filter sections may be any suitable ratio. The lengths of the filter sections may depend upon the arrangement of the capsules.

In embodiments wherein the first and second capsule are disposed in a first filter section and the third capsule is disposed in a second filter section, the first filter section may be about 16 mm, 17 mm, 18 mm, 19 mm, 20 mm, 21 mm or 22 mm in length in length, and/or the second filter section may be about 6 mm, 7 mm, 8 mm, 9 mm, 10 mm or 11 mm in length. In embodiments wherein the first capsule is disposed in a first filter section and the second and third capsules are disposed in a second filter section, the first filter section may be about 6 mm, 7 mm, 8 mm, 9 mm, 10 mm or 11 mm in length, and/or the second filter section may be about 16 mm, 17 mm, 18 mm, 19 mm, 20 mm, 21 mm or 22 mm in length in length.

In some embodiments wherein the first capsule is disposed in a first filter section and the second and third capsules are disposed in a second filter section, the first filter section is about 10 mm in length, and the second filter section is about 17 mm in length. In some embodiments wherein the first and second capsules are disposed in a first filter section and the third capsule is disposed in a second filter section, the first filter section is about 17 mm in length, and the second filter section is about 10 mm in length.

In some embodiments wherein the first capsule is disposed in a first filter section and the second and third capsules are disposed in a second filter section, the first filter section is about 9 mm in length, and the second filter section is about 18 mm in length. In some embodiments wherein the first and second capsules are disposed in a first filter section and the third capsule is disposed in a second filter section, the first filter section is about 18 mm in length, and the second filter section is about 9 mm in length.

The length of the filter sections is measured parallel to the axis of the filter.

When the filter comprises a first and second filter sections, it is possible to produce filters with a higher degree of conformity. For example, it is possible to produce filters that consistently have three capsules comprised therein. For detection of more than one capsule in a filter section it is important to have the capsules separated by a minimum distance. This distance corresponds with the accuracy of the machinery used to check whether a capsule has been incorporated into a filter section successfully. When three or more capsules are incorporated into a single filter section, it is difficult to maintain the required separation between the capsules such that each of capsules can be detected, for example during quality control. The result is that some filters may include more than three capsules whilst some may include less than three capsules. However, where the three capsules are distributed throughout two or more filter sections in accordance with some embodiments of the present invention it is possible to maintain the minimum required separation. For example, when the second and third capsules are incorporated into a single filter section is possible to determine the position of the capsules within the filter section as well as their separation from each other. A filter section as such can be combined with a similar filter section in which the position of the capsule is known. Using this method it is possible to ensure that filters with three capsules are consistently produced, and that the capsules are positioned within acceptable tolerances of the desired capsule locations in the filter. For example, by enabling the capsule positions to be reliably detected, such embodiments can ensure that the third capsule is located at least a minimum distance from the mouth end of the filter, to avoid visible shadowing at the exposed end of the filter. Additionally, such embodiments can ensure that the first and second capsules are located away from a zone in which ventilation openings are to be formed, so that the capsules will not be damaged when forming the ventilation openings.

In order to ensure that smoke is drawn through the filter with limited resistance, perforations may be provided in the filter to provide a ventilation effect. The perforations may be positioned anywhere on the surface of the filter and extend into the filter. In some embodiments, the perforations extend partially through the filter. In some embodiments, the perforations extend through the entirety of the filter. In some embodiments, the perforations are disposed in a pattern on the surface of the filter. In some embodiments, the perforations form a line spanning the circumference of the filter.

In some embodiments, when the filter comprises a first filter section and a second filter section, the first filter section may comprise perforations disposed in a line along the circumference of the first filter section, the line being perpendicular to the longitudinal axis of the first filter section.

Preferably, the perforations may be disposed between a first end of the first filter section and the first capsule, the first end of the first filter section being disposed closer to the mouth end of the filter than the first capsule. Filters according to this embodiment display maintained structural rigidity whilst providing the necessary ventilation effect. In some embodiments, the perforations may be disposed between 17 mm and 22 mm from the mouth end of the filter. Preferably, the perforations are disposed at 20 mm from the mouth end of the filter.

Alternatively, the perforations may be disposed in a region of the first filter section in which the first capsule is disposed in. In this embodiment, it is preferably that the perforations are formed using a laser, the laser being configured to form 24 individual perforations. The laser may be configured to use a pulse width of 100 μs. Perforations formed from such lasers do not damage the capsules contained in the filter. In these embodiments, the perforations may be disposed between 18 mm and 25 mm, preferably between 21 mm and 23 mm from the mouth end of the filter. More preferably, the perforations are disposed 21 or 22 mm from the mouth end of the filter.

The first capsule may be disposed in centrally along the longitudinal axis of the first filter section. Alternatively, the first capsule may be disposed off-centre along the longitudinal axis of the first filter section. When the capsule is disposed off-centre, the capsule may be disposed closer to a first end of the first filter section than a second end of the first filter section, the first end of the first filter section being disposed closer to the mouth end of the filter than the second end of the first filter section. In some embodiments, the first capsule is disposed 4 mm from the first end of the first filter section. In some embodiments, the first capsule is disposed 5 mm from the first end of the first filter section. Preferably, the first capsule is disposed 4 mm from the first end of the first filter section. When the first capsule is disposed 4 mm from the first end of the first filter section it is possible to maintain a uniform filter colour, even after the third capsule has been broken.

In some embodiments, the filter is wrapped by plug wrap. In some embodiments the plug wrap is high wet strength plug wrap. High wet strength plug wrap also helps to maintain a uniform filter colour, even after the third capsule has been broken.

The capsules can be surrounded by filtration material.

The capsule can be elongate. The capsule can have a longitudinal axis which is parallel to an axial direction of the smoking article or filter in which the capsule is located. The capsule can be substantially tubular, and have a maximum cross-sectional area defined in a plane perpendicular to the longitudinal axis. The cross-sectional area of the capsule can be substantially constant along a majority of the length of the capsule. Alternatively, the cross-sectional area of the capsule may vary along its length. The term "elongate" may be considered to mean that the dimension of the capsule in one direction is substantially greater than the dimension of the capsule in the two perpendicular directions. The longer dimension is beyond manufacturing tolerances for a substantially spherical capsule. For example, the longer dimension may be at least 1.5 times the maximum lateral dimension, or at least two times the maximum lateral dimension.

The capsule can have an exterior surface which is substantially cylindrical. The longitudinal ends can be rounded, for example, such that the ends are substantially hemispherical. The capsule can comprise an outer wall and an inner volume filled with the fluid. The additive can be selectively released by the user of the smoking article into the adjacent filtration material by squeezing the outside of the filter to deform or rupture the outer wall of the capsule.

The capsule can be configured to release all of the additive contents when the outer wall is ruptured. Alternatively, the capsule can be configured to release only a part of the additive on inward pressure from a user, such that the capsule is configured to release the additive contents in a plurality of discrete deliveries.

A known smoking article can generally have a maximum lateral dimension, which is a diameter for a circular cross-section. In the case of a cigarette in the superslim format, or a filter therefor, the maximum lateral dimension, or diameter, may be 5-6 mm, for example, approximately 5.4 mm, which may be known as a superslim. The filter will normally be marginally smaller in diameter than the filter, in order to accommodate wrapping paper. A spherical capsule may have a diameter which is a relatively large proportion of the cross-sectional area of the filter. The capsule may cause an adverse effect on smoke flow rate and/or pressure drop. The capsule may have a relatively small diameter, such that the effect of the capsule on the properties of the filter is reduced. The capsule can be elongate, instead of spherical, such that a sufficient quantity of additive can be contained. The maximum lateral dimension of the capsule is less than 4 mm, or less than 3.5 mm, and preferably from 2.2 mm to 2.8 mm. Elongate capsules may have lengths of from 7 mm to 11 mm, e.g. from 8 mm to 10 mm or approximately 9 mm. Alternatively, the length may be from 5 mm to 7 mm, e.g. approximately 5.5 mm.

The combination of an capsule with a maximum lateral dimension (diameter) of less than 3.5 mm, in a smoking article or filter having a slim, demi-slim or superslim format provides a required quantity of additive and affects the smoke flow rate and/or pressure drop within an acceptable threshold. The particular dimensions (lateral and length) of the elongate capsule, in a smoking article of these small diameter formats provides an advantageous combination of parameters which provide the required quantity of additive without significantly affecting the pressure drop.

Alternatively, the capsule can have a shape which is not elongate. In some aspects, the capsule may be spherical or substantially spherical. For a particular maximum lateral dimension (diameter), a spherical capsule may be able to contain less quantity of additive than an elongate capsule. For a smaller diameter of filter or smoking article, the reduced quantity of additive can be substantially as effective as a higher quantity of additive in a larger diameter filter or smoking article. The smaller diameter of filter or smoking article can have a maximum lateral dimension less than 7.6 mm or less than 7 mm, or any range specified in any embodiment. The diameter of the spherical capsule can be less than 3.5 mm, or any range of diameter specified in any embodiment. The radial dimensions apply to both elongate and spherical capsules.

A length of the capsule can be from 4 mm to 15 mm. The capsule has an exterior length from 7 mm to 11 mm, and in some aspects, from 8 mm to 10 mm, or approximately 9 mm.

Alternatively, the capsule can have an exterior length from 4 mm to 15 mm, and in some aspects, from 5 mm to 7 mm, or from 5 mm to 6 mm. In some aspects, the capsule length is approximately 5.5 mm. The capsule maximum lateral extent can be from 2.2 mm to 2.8 mm, and is preferably approximately 2.5 mm.

Alternatively, the length of the capsule is from 11 mm to 15 mm, or from 12 to 14 mm, or approximately 13.6 mm. The capsule maximum lateral extent can be from 2.2 mm to 2.8 mm, and is approximately 2.5 mm.

Alternatively, the exterior maximum lateral extent, or diameter for a circular cross-section, of the capsule of any type or embodiment may be within the range 4.5 mm to 7 mm. The maximum lateral extent may be less than 7 mm, less than 6 mm, less than 5 mm or less than 4 mm. The maximum lateral extent may be between 3 mm and 4 mm. In particular, the maximum lateral extent of the capsule may be between 3 mm and 4 mm (e.g. approximately 3.5 mm) in combination with a filter/smoking article having a diameter of between 5 mm and 6 mm (e.g. approximately 5.4 mm). The maximum lateral extent may be greater than 1 mm, in combination with any upper limit, capacity or relative cross-sectional area.

These dimensions may apply to any type of capsule. The larger length additive release component can be used with an capsule comprising a substrate. The substrate may contain approximately 40% of additive by volume.

The diameter and length of the capsule determines the maximum volume of additive which can be contained. Therefore, the selection of a relatively small diameter can be used in combination with a relatively high length in order to contain a required quantity of additive. Any combination of dimensions, including dimensions outside of the ranges indicated, may be used. The outer shell of any embodiment can have a thickness of approximately 0.2 mm.

The use of capsules having a maximum lateral dimension (or diameter for a circular cross-section) of less than 3.5 mm, from about 2.7 mm to about 3.1 mm or about 3 mm can ensure that uniform filter colour is maintained upon rupture of one or more of the capsules, by reducing or eliminating 'spotting' of the filter (wherein capsule contents soak through to the surface of and form spots on the filter), even after the third capsule has been ruptured.

Inclusion of three capsules comprising additive and having a maximum lateral dimension (or diameter for a circular cross-section) of less than 3.5 mm, from about 2.7 mm to about 3.1 mm or about 3 mm into a filter for a smoking article can also provide the consumer with a choice of which additive to release and/or how much additive to release by choosing to crush none, 1, 2, or all 3 capsules, whilst reducing or eliminating 'spotting' of the filter.

The smoking articles or filters containing the capsule can have a diameter of from 4 mm to 10 mm, for example from 5 mm to 7 mm, or y from 5 mm to 6 mm, or from 5.1 mm to 6 mm (superslim). In some aspects, from 5.2 mm to 5.6 mm, or from 5.3 mm to 5.5 mm, for example approximately 5.4 mm. Where the smoking article or filter is in the slim, demislim, superslim or microslim format, it can have a diameter of less than about 7.6, 7.0, 6.0 and 5.1 mm respectively (corresponding approximately to circumferences less than 24, 22, 19 and 16 mm respectively). Where the smoking article or filter is in the regular format, it can have a diameter of 7.6-8.0 mm (corresponding approximately to a circumference of 24-25 mm) So called "wide" formats can have, diameters larger than 8.0 mm (corresponding approximately to circumferences greater than 25 mm).

The small lateral extent of the capsule may be advantageous for reducing pressure drop in any diameter smoking article, although the advantage has a particular effect for the smaller diameter smoking article. The invention is applicable to any diameter of smoking article or filter in combination with a relatively sized capsule. For example, the smoking article may have a diameter of from one of: 5 mm, 5.3 mm, 5.5 mm, 6 mm, 6.5 mm, 7 mm, 7.3 mm, 7.5 mm, 7.7 mm, 8 mm to one of 5.5 mm, 6 mm, 6.5 mm, 7 mm, 7.5 mm, 7.9 mm, 8.5 mm, in an any combination.

The capsule may have an additive capacity from 3 μL, to 50 μL, or from 3 μL to 10 μLL, or from 10 μL to 30 μL, and optionally from 15 μL to 25 μL or from 20 μL to 30 μL or from 8 μL to 20 μL, or approximately 20 μL or approximately 30 μL. Any upper or lower value of capacity may be used in combination. In particular, the capacity of the capsule may be from one of: 3 μL, 5 μL, 8 μL, 10 μL, 15 μL, 20 μL, 25 μL, 30 μL, 35 μL, 40 μL to one of: 5 μL, 8 μL, 10 μL, 15 μL, 20 μL, 25 μL, 30 μL, 35 μL, 40 μL, 45 μL, 50 μL.

Alternatively, the maximum lateral extent of the capsule may be one of from: 1.5 mm to 2.5 mm, 1.5 mm to 3 mm, 1.5 mm to 3.5 mm, 2 mm to 2.5 mm, 2 mm to 3 mm, 2 mm to 3.5 mm, 2.5 mm to 3 mm, 2.5 mm to 3.5 mm, 3 mm to 4 mm, 3.5 mm to 4 mm. The maximum lateral extent of the additive release component may be from a lower lateral extent of one of 1.0 mm, 1.1 mm, 1.2 mm, 1.3 mm, 1.4 mm, 1.5 mm, 1.6 mm, 1.7 mm, 1.8 mm, 1.9 mm, 2.0 mm, 2.1 mm, 2.2 mm, 2.3 mm, 2.4 mm, 2.5 mm, 2.6 mm, 2.7 mm, 2.8 mm, 2.9 mm, 3.0 mm, 3.1 mm, 3.2 mm, 3.3 mm, 3.4 mm, 3.5 mm, 3.6 mm, 3.7 mm, 3.8 mm, 3.9 mm, 4.0 mm, 4.1 mm, 4.2 mm, 4.3 mm, 4.4 mm and to a higher lateral extent of one of: 1.6 mm, 1.7 mm, 1.8 mm, 1.9 mm, 2.0 mm, 2.1 mm, 2.2 mm, 2.3 mm, 2.4 mm, 2.5 mm, 2.6 mm, 2.7 mm, 2.8 mm, 2.9 mm, 3.0 mm, 3.1 mm, 3.2 mm, 3.3 mm, 3.4 mm, 3.5 mm, 3.6 mm, 3.7 mm, 3.8 mm, 3.9 mm, 4.0 mm, 4.1 mm, 4.2 mm, 4.3 mm, 4.4 mm, 4.5 mm, 4.6 mm, 4.7 mm, 4.8 mm, 4.9 mm, 5.0 mm, 5.1 mm, 5.2 mm, 5.3 mm, 5.4 mm, 5.5 mm, 5.6 mm, 5.7 mm, 5.8 mm, 5.9 mm, 6.0 mm, 6.1 mm, 6.2 mm, 6.3 mm, 6.4 mm, 6.5 mm, 6.6 mm, 6.7 mm, 6.8 mm, 6.9 mm, 7.0 mm, 7.17 mm, 7.2 mm, 7.3 mm, 7.4 mm, 7.5 mm, 7.6 mm, 7.7 mm, 7.8 mm, 7.9 mm, 8.0 mm in any combination.

These ranges are not, however, intended to be limiting and the skilled person would understand that larger or smaller filter or capsules could be employed. References to diameter indicate the maximum lateral dimension of the capsule. For a capsule which is not circular in cross-section, the diameter values above indicate the maximum lateral dimension of the capsule.

The capsule has a maximum radial cross-sectional area. The area of the capsule relative to the radial cross-sectional area of the section of the smoking article containing the capsule may determine whether the restriction of smoke flow or pressure drop due to the capsule is within acceptable limits. In some aspects, the capsule can be less than 50% of the radial cross-sectional area of the section containing the capsule, for example less than 45%, less than 40%, less than 35%, less than 30%, less than 25%, less than 20%, less than 15%, or less than 10%. Alternatively, maximum radial cross-sectional area of the capsule may be less than 65%, less than 60%, or less than 55% of that of the section of the cigarette of filter containing the component. The cross-sectional area of the capsule may be higher than 5%, 10%, 15%, 20%, 25%, 30%, 35%, 40%, or 45% of the filter or smoking article, in combination with any upper limit.

Alternatively, the maximum radial cross-sectional area of the capsule, expressed as a percentage of the radial cross-sectional area of the section of the smoking article or filter containing the additive release component, may be more than 50%. The ratio may be less than 55%, 60%, 65%, 70%, 75%, 80%, 85%, 90% or 95%. Alternatively, the ratio may be more than 5%, 10%, 15%, 20% 25%, 30%, 35%, 40%, 45%, 50%, 55%, 60%, 65%, 70%, 75%, 80%, 85%. 90% or 95%.

The invention may comprise filters and smoking articles, particularly cigarettes, in which the maximum radial cross-sectional area of the capsule expressed as a percentage of the radial cross-sectional area of the section containing the capsule lies in a range between any two values described above.

This range may be from 15% to 50%, or In some aspects, from 20% to 35%, or from 30% to 45%, or from 25% to 40%, or from 30% to 40%.

In particular, where a capsule has the above area relative to a section of the smoking article containing the capsule, the diameter of that section may be less than 8 mm, less than 7.5 mm, less than 7 mm, or less than 6 mm. For example, the section of the smoking article containing the capsule may have a diameter of from 5 mm to 6 mm, or from 6 mm to 7 mm, or from 5 mm to 7.5 mm. Alternatively, the diameter of this section of the smoking article may be greater than 8 mm.

The capsule may have a maximum lateral cross-sectional area of less than 40 $mm^2$, less than 30 $mm^2$, less than 20 $mm^2$, less than 15 $mm^2$, and in some aspects, less than 10 $mm^2$, less than 8 $mm^2$, less than 6 $mm^2$, less than 5 $mm^2$. The lateral cross-sectional area may be greater than 1 $mm^2$, 2 $mm^2$, 3 $mm^2$, 4 $mm^2$, 5 $mm^2$ or 6 $mm^2$, in combination with any upper limit.

BRIEF DESCRIPTION OF THE DRAWINGS

Embodiments of the invention will now be described, by way of example only, with reference to the accompanying drawings, in which.

DETAILED DESCRIPTION

Figure 1:
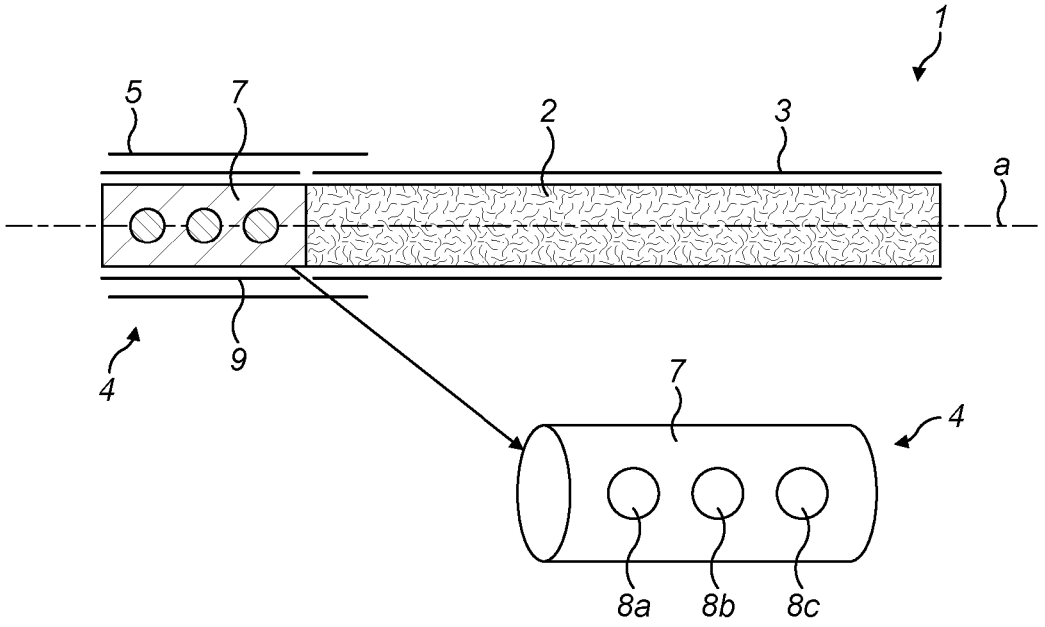
FIG. 1 is a schematic illustration of a smoking article having a filter with a tubular downstream filter section and an upstream filter section including an encapsulated additive in the form of a frangible capsule.

As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn/tobacco heating products and aerosol generating products such as c-cigarettes. For convenience, these will be referred to as "smoking articles" in this specification. The term "aerosol" covers smoke, e.g. tobacco smoke. Such smoking articles may be provided with a filter for the gaseous flow drawn by the smoker.

The term "smoking article" includes cigarettes, cigars and cigarillos as well as roll-your-own-products and make-your-own products.

Smoking articles such as cigarettes and their formats are often named according to the cigarette length: "regular" (typically in the range 68-75 mm, e.g. from about 68 mm to about 72 mm), "short" or "mini" (68 mm or less), "king-size" (typically in the range 75-91 mm, e.g. from about 79 mm to about 88 mm), "long" or "super-king" (typically in the range 91-105 mm, e.g. from about 94 mm to about 101 mm) and "ultra-long" (typically in the range from about 110 mm to about 121 mm).

They are also named according to the cigarette circumference: "regular" (about 23-25 mm), "wide" (greater than 25 mm), "slim" (about 22-23 mm), "demi-slim" (about 19-22 mm), "super-slim" (about 16-19 mm), and "micro-slim" (less than about 16 mm). Accordingly, a cigarette in a king-size, super-slim format will, for example, have a length of about 83 mm and a circumference of about 17 mm. Cigarettes in the regular, king-size format are preferred by many customers, namely with a circumference of from 23 to 25 mm and an overall length of from 75 to 91 mm.

Each format may be produced with filters of different lengths, smaller filters being generally used in formats of smaller lengths and circumferences. Typically the filter length will be from 15 mm, associated with short, regular formats, to 30 mm, associated with ultra-long super-slim formats. The tipping paper will have a greater length than the filter, for example from 3 to 10 mm longer.

Smoking articles and filters described hereinafter can be manufactured in any of the above formats. The smoking article can, for instance, be from 70 to 100 mm in length and from 14 to 25 mm in circumference.

The terms 'upstream' and 'downstream' used herein are relative terms defined in relation to the direction of mainstream smoke (or other aerosol) drawn though a smoking article in use.

Herein, distances measured from one capsule to another are measured from the centre a first capsule to the centre of second capsule.

Herein, the units "mm/Wg" refer to millimetres/water gauge (also known as mm $H_2O$). Herein, these measurements were carried out on individual filter sections.

FIG. 1 is a schematic illustration of a smoking article 1 which is generally cylindrical in shape and is in the regular, king size format, namely having a length in the range 75-91 mm and a circumference in the range 23 to 25 mm. The smoking article 1 includes a tobacco rod 2 wrapped in a wrapping material 3, in this example cigarette paper, connected longitudinally to a filter 4 by tipping material 5 overlaying the filter 4 and partially overlaying the wrapping material 3 so as to connect the filter 4 to the tobacco rod 2. The filter 4 comprises absorbent material 7 having capsules 8*a*, 8*b*, 8*c* disposed therein in an axial region proximal a longitudinal axis of the filter 4. The axial region is a region, in the present example, centred on the axis 'a' of the smoking article 1, having a radius of about 3 mm. In alternative embodiments, the radius of the axial region can be anywhere from 1 mm to 4 mm, or from 1 mm to 3 mm, or about 1 mm, 1.5 mm, 2 mm, 2.5 mm, 3 mm or 3.5 mm. Capsules 8*a*, 8*b*, 8*c* are spaced in sequence in a direction along the axis 'a'. The capsules 8*a*, 8*b*, 8*c* can be disposed only in the axial region of the filter 4, or can be disposed in greater concentration in the axial region than in non-axial regions of the filter material of the filter 4. The filter is wrapped in plug wrap 9.

The filter 4 is a cellulose acetate segment formed using continuous cellulose acetate fibres and a plasticizer. The capsules 8*a*, 8*b*, 8*c* are spherical and have a diameter of 2.8 mm, although other shapes and sizes of capsule can be used, and contains a fluid additive which modifies properties of mainstream smoke passing through the smoking article 1. The capsules 8*a*-8*c* can be manufactured and inserted into the filter 4 using existing processes and machinery. In the present example, the capsules 8*a*-8*c* contain menthol flavourant, although other fluids or granular additives could be contained within the capsules 8*a*-8*c*. The capsules can be ruptured by a consumer to release the fluid additive into the absorbent filter material 11.

The axis of the smoking article 1, about which the tobacco rod 2 and the filter 4 are aligned, is indicated as 'a' in FIG. 1.

Figure 2:
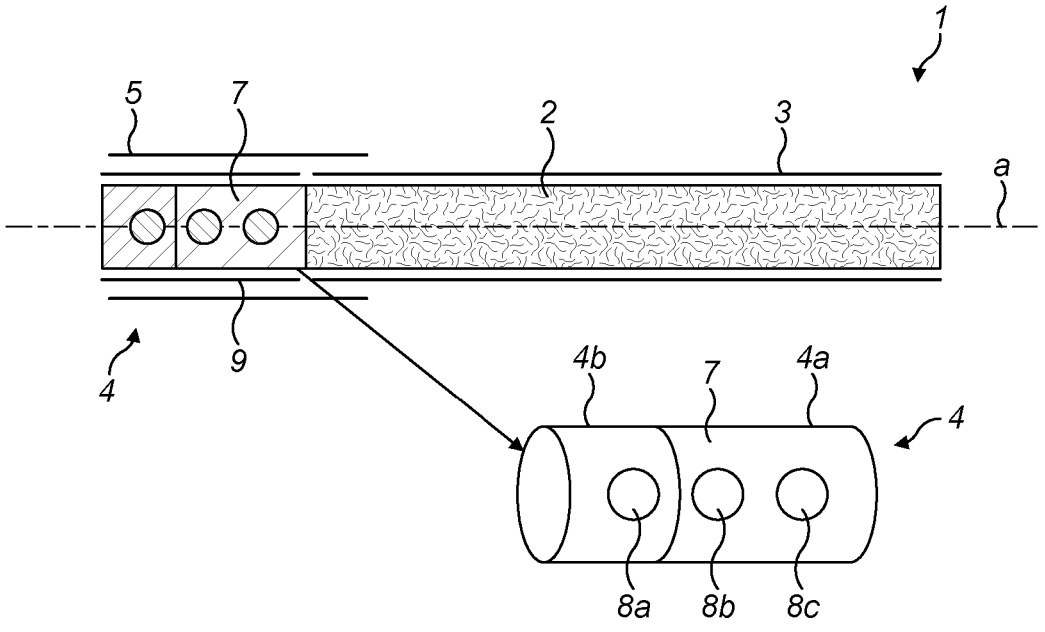
FIG. 2 is a schematic illustration of a smoking article having a filter comprising two filter sections.

FIG. 2 is a schematic illustration of a smoking article 1 according to FIG. 1, further comprising a filter 4 having two filter sections 4*a* and 4*b*, the first filter section 4*a* is disposed further from the mouth end of the filter than the second filter section 4*b*, wherein a first capsule 8*c* and second capsule 8*b* are disposed in the first filter section and a third capsule 8*a* is disposed in the second filter section.

Figure 3:
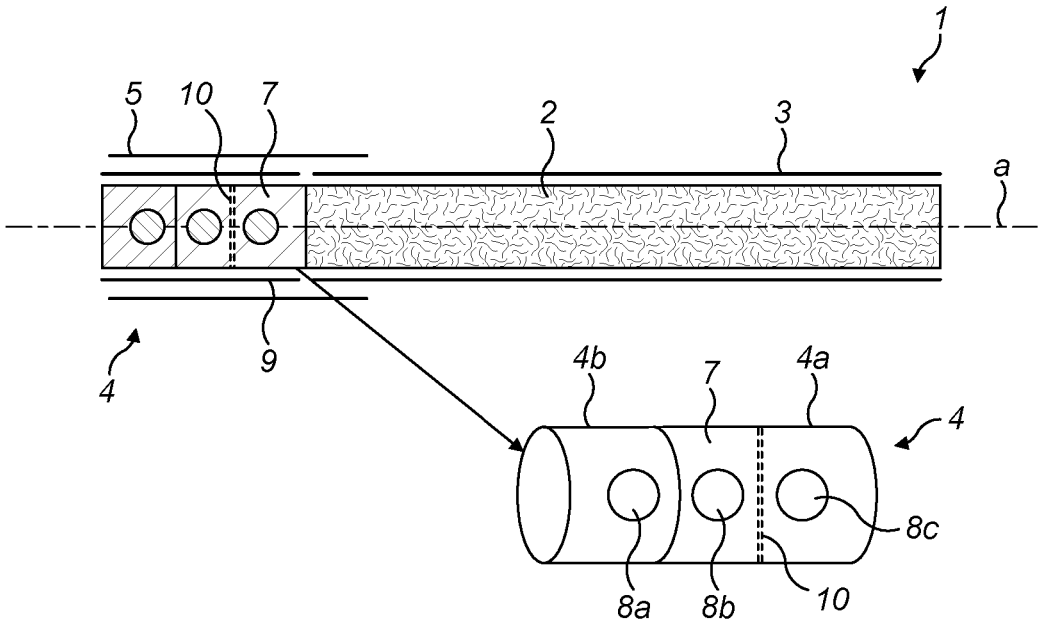
FIG. 3 is a schematic illustration of a smoking article according to FIG. 2, further comprising perforations.

FIG. 3 is a schematic illustration of a smoking article according to FIG. 2, further comprising perforations 10 to provide a ventilation effect, wherein the perforations 10 are disposed in a region of the first filter section 4*a*.

In use, the tobacco rod 2 of the smoking article 1 is lit by a consumer in the conventional manner and tobacco smoke is drawn from burning coal of the tobacco rod 2 through the filter 4. When the consumer breaks the capsules one, two or three of 8*a*-8*c* either prior to or in the course of smoking the smoking article 1, the additive contained therein, in the present case menthol, is released in into the filter 4 and affects the characteristics of the smoke drawn through the filter.

Specific embodiments of the invention have been described, although the invention is not limited to such embodiments.

EXAMPLE 1

Multi-Section Filter with Ventilation

1A: Perforations Formed at the Boundary Between Filter Sections

Figure 4A:
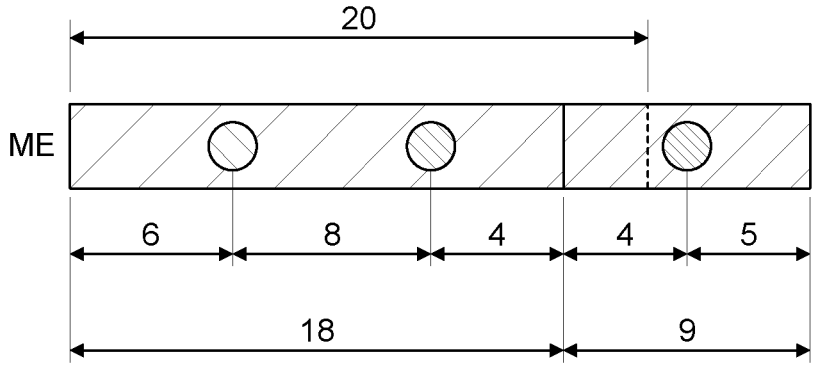
FIG. 4*a* is a schematic illustration of a filter comprising two filter sections further comprising perforations, and showing the location of the capsules.

Filters comprising two filter sections were manufactured, wherein a first filter section having a length of 9 mm was disposed further from the mouth end (ME) of the filter than the second filter section, which had a length of 18 mm. The boundary between the first and second filter sections was therefore 18 mm from the mouth end of the filter, as shown in FIG. 4*a*.

Three capsules were inserted, with the first capsule disposed in the first filter section and the second and third capsule disposed in the second filter section. The first capsule was disposed around 22 mm from the mouth end of the second filter section. The distance between the first capsule and the second capsule was around 8 mm, so that the second capsule was disposed around 14 mm from the mouth end of the second filter section. The distance between the second capsule and the third capsule was around 8 mm, so that the third capsule was disposed around 6 mm from the mouth end of the second filter section. As set out above, distances measured from one capsule to another are measured from the centre of a first capsule to the centre of a second capsule. This arrangement is shown in FIG. 4*a*. Perforations were formed at the boundary of the first and second filter sections at a location 18 mm from the mouth end of the filter (not shown in Figures) using various pulse widths.

Perforations were formed using a Burghart Messtechnik CVB-1700 off-line laser:

Laser power: 120 W

Wave length: 10.6 μm

Spot size: 0.18 mm

Vent trials were undertaken using sample numbers shown in Table 1, below.

TABLE 1

| | | Sample numbers | | | |
|---|---|---|---|---|---|
| | | Number of Perforations | | | |
| | | 8 | 16 | 24 | 28 |
| Pulse | 5 | 18-5-8 | 18-5-16 | 18-5-24 | 18-5-28 |
| Width | 25 | 18-25-8 | 18-25-16 | 18-25-24 | 18-25-28 |
| (ms) | 50 | 18-50-8 | 18-50-16 | 18-50-24 | 18-50-28 |
| | 100 | 18-100-8 | 18-100-16 | 18-100-24 | 18-100-28 |
| | 200 | 18-200-8 | 18-200-16 | 18-200-24 | 18-200-28 |
| | 400 | 18-400-8 | 18-400-16 | 18-400-24 | 18-400-28 |

Ventilation was measured using a Cerulean™ QTM5. Data obtained from vent trials is shown in Table 2, below.

TABLE 2

| | | Vent percentage for specified pulse widths and number of perforations. | | | |
|---|---|---|---|---|---|
| | | Number of perforations | | | |
| | | 8 | 16 | 24 | 28 |
| Pulse | 5 | 0.13 | 0.18 | 0.16 | 0.12 |
| Width | 25 | 5.2 | 10.09 | 14.44 | 14.55 |
| (μs) | 50 | 9.16 | 16.78 | 24.39 | 27.40 |
| | 100 | 12.7 | 24.87 | 34.82 | 38.10 |

TABLE 2-continued

| | | Vent percentage for specified pulse widths and number of perforations. | | | |
|---|---|---|---|---|---|
| | | Number of perforations | | | |
| | | 8 | 16 | 24 | 28 |
| | 200 | 17.97 | 31.81 | 43.98 | 48.60 |
| | 400 | 24.52 | 41.42 | 56.61 | 57.50 |

Samples of 40 filters were then tested using tensile strength test equipment and standard protocols to establish failure (number of snap offs). Results are shown in Table 3, below.

TABLE 3

| | | number of filter failures (snap offs), out of a sample size of 40 in each case, for filters with perforations formed between the boundary of the first filter section and the second filter section (18 mm from the mouth end of the filter). | | | |
|---|---|---|---|---|---|
| | | Number of perforations | | | |
| | | 8 | 16 | 24 | 28 |
| Pulse | 5 | 8 | 3 | 3 | 13 |
| Width | 25 | 7 | 6 | 13 | 15 |
| (μs) | 50 | 7 | 13 | 14 | 14 |
| | 100 | 7 | 4 | 22 | 20 |
| | 200 | 10 | 12 | 21 | 23 |
| | 400 | 19 | 24 | 27 | 30 |

As shown by the results in Table 3, perforations formed at the boundary of the first and second filter sections led to unacceptable levels of filter breakage during filter stress testing.

1B: Perforations Formed in the Region of the First Filter Section

Filters were manufactured and capsules inserted in accordance with 1A, above.

Perforations were formed using a Burghart Messtechnik CVB-1700 off-line laser as detailed in 1A, above.

Perforations were formed in the first filter section, in which the first capsule was disposed, at a location 22 mm from the mouth end of the filter using various pulse widths. The perforations were therefore located between the boundary of the first and second filter sections and the tobacco end of the first filter section; and over the centre of the first capsule (not shown in figures).

Samples of 40 filters were then tested: ventilation was measured using a Cerulean™ QTM5; tensile strength test equipment and standard protocols were used to establish failure (number of snap offs); and the filters were inspected for capsule damage. The results are provided in Table 4, below.

TABLE 4

| Pulse Width (μs) | Number of perforations | Ventilation % | Vent Suitable for Design | Capsule Damage | Snapoff (out of 40) | Acceptable |
|---|---|---|---|---|---|---|
| 5 | 24 | 0.02 | No | None | 13 | N |
| 25 | 24 | 11.40 | No | None | 7 | N |
| 50 | 24 | 20.37 | No | None | 6 | N |
| 100 | 24 | 30.98 | Yes | None | 4 | Y |
| 200 | 24 | 38.88 | No | All Samples | 5 | N |
| 400 | 24 | 51.79 | No | All Samples | 1 | N |

As shown in Table 4, filters with perforations formed between the boundary of the first and second filter sections and the tobacco end of the first filter section showed significantly decreased levels of filter breakage during stress testing compared to filters with perforations at the boundary between filter sections (as shown in Table 3).

As further shown in Table 4, a laser configured to create 24 perforations using a 100 μs pulse width was capable of achieving the required ventilation effect (between 25 and 35% ventilation) in addition to ensuring the structural integrity of the filter (low filter snapoff) and without damaging the first capsule.

EXAMPLE 2

Capsule Detection & Testing

2A: Multi Section Filter Capsule Detection

Figure 4B:
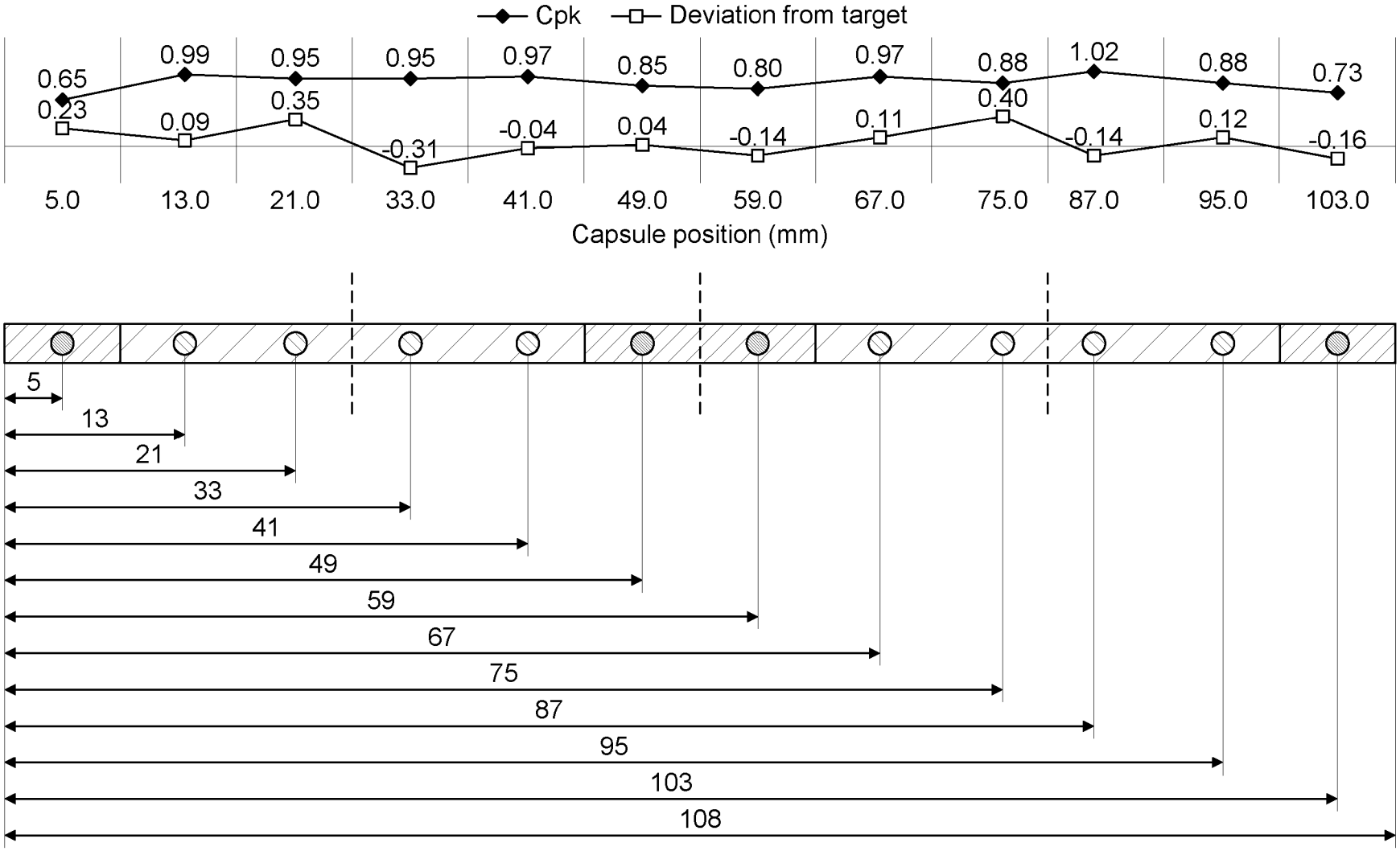
FIG. 4*b* shows the results of capsule detection in a filter comprising multiple sections.

Filters comprising multiple sections were manufactured and capsules inserted as shown in FIG. 4*b*.

The location of the capsules was detected using a detection system either from Essentra™ (on-line detection system); or TEWS Elektronic™ (an off-line detection system).

The upper part of FIG. 4*b* shows capsule deviation from the target and Cpk (a measure of process capability). These results demonstrate the accurate detection of capsules located within a filter.

2B: Capsule Tolerance and Filter Staining

Filters comprising a single filter section were manufactured and capsules inserted. Details are provided in Table 5, below.

As can be seen from Table 5, in Examples 1-3, a capsule was disposed 4 mm from the first end of the filter section. In Examples 4-6, a capsule was disposed 5 mm from the first end of the filter section. Example 7 was the same as example 3, except the filter used 27 GSM plug wrap instead of high wet strength plug wrap (HWS).

The location of the capsules was detected using a detection system either from Essentra™ (on-line detection system); or TEWS Elektronic™ (an off-line detection system).

The capsules within the filters were then crushed and the filters were visually inspected and visual measurements taken every five minutes for five minutes to detect presence of the capsule contents at the tobacco end of the filter. Results are set out in Table 5.

TABLE 5

| Example | Capsule Tolerance M/C Setting | Capsule position from first end | Plugwrap | Visible mouth end capsule (%) | Change in filter colour after breakage of capsules (%) |
|---|---|---|---|---|---|
| 1 | 1.5 mm | 4 | HWS | 0.9 | 1.8 |
| 2 | 1.75 mm | 4 | HWS | 2.1 | 10.9 |
| 3 | 2.0 mm | 4 | HWS | 3.9 | 7.3 |
| 4 | 2.0 mm | 5 | HWS | 2.4 | 8.2 |
| 5 | 1.5 mm | 5 | HWS | 7.0 | 24.5 |
| 6 | 1.75 mm | 5 | HWS | 1.3 | 31.8 |
| 7 | 2.0 mm | 4 | 27 GSM | 3.7 | 35.5 |

The capsule tolerance manufacturing machine (M/C) setting is the reject limit for the detection system used.

As shown in Table 5, examples 1-3 show a significantly lower occurrence rate of filter colour change than examples 4-6. Furthermore, HWS plug wrap is shown to exhibit a lower occurrence rate of filter colour change than 27 GSM plug wrap.

In order to address various issues and advance the art, the entirety of this disclosure shows by way of illustration various embodiments in which the claimed invention(s) may be practiced and provide for superior delivery of a smoke modifying additives. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A filter for a smoking article or an aerosol generating product comprising filter material and three frangible capsules having a diameter of from about 2 mm to about 6 mm and comprising additive, the capsules being embedded in the filter material and disposed in sequence in a direction along a longitudinal axis of the filter wherein the circumference of the filter material is from about 14 mm to about 28 mm and the filter material has fibers having about 3 denier per filament (dpf) to about 10 dpf.

2. The filter according to claim 1, wherein the capsules contain flavourants.

3. The filter according to claim 2, wherein the flavourant is liquid.

4. The filter according to claim 2, wherein the flavourant in one of said capsules differs from the flavourant in another of said capsules or wherein the flavourant in each of said capsules is different to the flavourant in each the other said capsules.

5. The filter according to claim 1, wherein the filter material has a total denier of from about 12,000 to about 40,000.

6. The filter according to claim 1, wherein the pressure drop of the filter, before the capsule is burst, is from about 85 mm/Wg to about 100 mm/Wg.

7. The filter according to any preceding claim, wherein the circumference of the filter material is from about 16 mm to about 18 mm, from about 19 mm to about 22 mm, or from about 23 mm to about 25 mm.

8. The filter according to claim 1, wherein the capsules have a burst strength of from about 14 N to about 18 N; and/or have a diameter of less than about 3.5 mm, or from about 2.7 mm to about 3.1 mm, or about 3 mm.

9. The filter according to claim 1, wherein the capsules are spherical and have a diameter of from about 2.7 mm to about 3.1 mm; or are spherical and have a diameter from about 2.8 mm to about 3.0 mm.

10. The filter according to claim 1, wherein the filter further comprises a first filter section and a second filter section, the first filter section being disposed further from a mouth end of the filter than the second filter section, wherein the first capsule of the three capsules is disposed in the first filter section and the second and third capsules of the three capsules are disposed in the second filter section.

11. The filter according to claim 10, wherein the first filter section is about 6 mm, 7 mm, 8 mm, 9 mm, 10 mm or 11 mm in length, and/or the second filter section is about 16 mm, 17 mm, 18 mm, 19 mm, 20 mm, 21 mm or 22 mm in length.

12. The filter according to claim 1, the filter further comprising a first filter section and a second filter section, the first filter section being disposed further from a mouth end of the filter than the second filter section, wherein the first and second capsules of the three capsules are disposed in the first filter section and the third capsule is disposed in the second filter section.

13. The filter according to claim 12, wherein the first filter section is about 16 mm, 17 mm, 18 mm, 19 mm, 20 mm, 21 mm or 22 mm in length, and/or the second filter section is about 6 mm, 7 mm, 8 mm, 9 mm, 10 mm or 11 mm in length.

14. The filter according to claim 10 or claim 12, wherein the first filter section comprises perforations disposed in a line along the circumference of the first filter section, the line being perpendicular to the longitudinal axis of the first filter section.

15. The filter according to claim 14, wherein the perforations are disposed between a first end of the first filter section and the first capsule, the first end of the first filter section being disposed closer to the mouth end of the filter than the first capsule, or wherein the perforations are disposed in a region of the first filter section in which the first capsule is disposed in.

16. The filter according to claim 14, wherein the perforations are formed using a laser, the laser configured to form 24 individual perforations.

17. A filter according to claim 10 or claim 12, wherein the first capsule is disposed closer to a first end of the first filter section than a second end of the first filter section, the first end of the first filter section being disposed closer to the mouth end of the filter than the second end of the first filter section.

18. The filter according to claim 1, wherein the filter is wrapped by high wet strength plug wrap.

19. A filter as claimed in claim 1 wherein the filter material: has a circumference of from about 16 mm to about 19 mm, has fibers having about 4.5 dpf to about 8 dpf, and has a total denier of from about 15,000 to about 25,000; and the capsules are spherical, have a diameter of from about 2.7 mm to about 3.1 mm, and have a burst strength of from about 14 N to about 18 N.

20. The filter as claimed in claim 1, wherein the capsules are embedded in the filter material in predetermined locations and in a predetermined sequence; the capsules are spherical and have a diameter from about 2.8 mm to about 3.0 mm; and each capsule comprises a different flavourant.

21. A filter for a smoking article or an aerosol generating product comprising filter material and three capsules comprising additive, the capsules being disposed in sequence in a direction along a longitudinal axis of the filter and being configured to be crushed during use of the filter, wherein the filter has a resistance to draw (RTD), before the capsules are crushed, of from about 80 mm/Wg to about 95 mm/Wg and a resistance to draw (RTD), after the capsules are crushed, of from about 90 mm/Wg to about 100 mm/Wg.

22. A smoking article or an aerosol generating product comprising a filter according to claim 1.

* * * * *